US007060157B1

(12) United States Patent
Bauer et al.

(10) Patent No.: US 7,060,157 B1
(45) Date of Patent: Jun. 13, 2006

(54) METHOD FOR PRODUCING UNDERGARMENTS BY USING GLUED JOINTS

(76) Inventors: Hans Bauer, Stollenau 8, D-72336 Ballingen (DE); Fred Zeschky, Lerchenstrasse 10, D-72348 Rosenfeld (DE); Peter Fröhlich, Stollenau 12, D-72336 Balingen (DE)

( * ) Notice: Subject to any disclaimer, the term of this patent is extended or adjusted under 35 U.S.C. 154(b) by 382 days.

(21) Appl. No.: 10/089,199

(22) PCT Filed: Sep. 2, 2000

(86) PCT No.: PCT/EP00/08573

§ 371 (c)(1),
(2), (4) Date: Jul. 5, 2002

(87) PCT Pub. No.: WO01/21019

PCT Pub. Date: Mar. 29, 2001

(30) Foreign Application Priority Data

Sep. 18, 1999 (DE) ..... 199 44 700

(51) Int. Cl.
*A41B 9/00* (2006.01)
*B32B 31/12* (2006.01)

(52) U.S. Cl. ..... 156/291; 156/329; 156/331.7; 156/338

(58) Field of Classification Search ..... 156/290–292
See application file for complete search history.

(56) References Cited

U.S. PATENT DOCUMENTS

| | | | | |
|---|---|---|---|---|
| 3,327,707 | A * | 6/1967 | Storti | 450/115 |
| 3,762,365 | A * | 10/1973 | Herzog | 118/212 |
| 4,701,964 | A | 10/1987 | Prunesti et al. | |
| 5,154,659 | A | 10/1992 | Gluckin | |

FOREIGN PATENT DOCUMENTS

| | | | |
|---|---|---|---|
| DE | 2146808 | | 9/1971 |
| DE | 296 09 672 | U1 | 5/1996 |
| DE | 299 03 484 | U1 | 2/1999 |
| EP | 623332 | A1 * | 11/1994 |
| EP | 0 809 945 | A2 | 12/1997 |
| EP | 0 852 915 | A2 | 12/1997 |
| GB | 2316353 | A | 5/1996 |

* cited by examiner

*Primary Examiner*—Sam Chuan Yao
(74) *Attorney, Agent, or Firm*—Myron Greenspan; Lackenbach Siegel, LLP

(57) ABSTRACT

The present invention relates to a method for the production of undergarments free of seams with high wearing and support comfort.

9 Claims, 3 Drawing Sheets

METHOD FOR PRODUCING UNDERGARMENTS BY USING GLUED JOINTS

BACKGROUND OF THE INVENTION

1. Field of the Invention

The invention relates to a method for producing, by means of adhesion connection, undergarments in particular brassieres, pantie-girdles, sports pants and the like.

2. Description of the Prior Art

In the case of the previously known undergarments the disadvantage is encountered, that seam connections are required in order to connect the different layers or parts of the undergarment with one another. However such seams have the disadvantage that the seam material has an elastic behavior which differs from the textile material itself such that the wearing properties are impaired.

In particular in the development of an undergarment as a brassiere the disadvantage exists that the wearing comfort is impaired when applying seams.

While brassieres have become known which are formed without seams, they suffer the disadvantage that the support and bearing force is strongly impaired since the elasticity is provided by the fabric alone and not by other addition means.

In this connection EP 0 809 945 A2 discloses a seamless ladies undergarment, in particular a brassiere, which is comprised of several parts which include textile, thermoplastically meltable fibers, the parts of which are thermally welded. Reinforcement parts can be laminated onto them to reinforce individual sections.

SUMMARY OF THE INVENTION

The invention is therefore based on the task of developing an undergarment without seams of the above type such that the wearing comfort is at least equal to or better than that of known undergarments, but that a significantly higher support force can be attained.

The central goal of the invention is to improve the support force of the undergarment at least in the marginal region where an elastomeric synthetic adhesion band is applied, which is disposed between the upper and the lower layer of the undergarment.

With invention's technical teachings, it is now possible for the first time to employ, instead of a seam, which is required by the prior art in order to seam the edges, an elastomeric adhesion connection, disposed at least in the marginal region of the undergarment and defines the marginal region.

If such an elastomeric adhesion band is employed as the margin region, the advantage is obtained that the margin regions of this undergarment are virtually elastically resilient and can be stretched like a rubber band, i.e. the entire garment develops very high support comfort.

The introduced elastomeric adhesive bands thus lend the undergarment an extraordinarily high resilient elasticity and very good extensibility such that two demands, which are contradictory per se, are combined with one another:

For one, excellent wearing comfort is attained, since all seams can be omitted and, for another, high support comfort and high support force is attained, since, due to the rubber-elastic properties of the elastomeric adhesive bands, which best completely surround the undergarment, high elasticity of the material and good adaptation to the body is obtained.

A preferred embodiment of the method provides that the elastomeric adhesive band is produced as an application of an adhesion substance in silk screen processes.

This means that an adhesive substance composition is passed through a silk screen, under which the undergarment is disposed, such that onto the lower layer of the undergarment initially an adhesive substance application is applied.

In order for this adhesive substance application to take place, as much as feasible semicircularly or ovally, it is further preferred that the lower layer of the undergarment is disposed in an approximately semicircular, oval or, in any case, deepened groove of the silk screen frame such that this grove can also be filled with the adhesive substance.

It can herein be provided that into this groove on the silk screen frame further additional insertion parts are emplaced, such as, for example, brassiere underwires or also closure means, such as for example hook closures, zipper closures or other fastening means.

Therewith the significant advantage results that into the adhesive substance beads now corresponding addition parts can be embedded, which are completely enclosed and encompassed by the adhesive substance such that no interfering abutment edges are generated since this part is completely surrounded by the elastomeric adhesive substance.

As soon as, in the state in which the substance has not yet set, the lower groove in the lower layer of the garment has been filled, the upper layer of the garment is placed onto it and pressed onto the lower layer, whereby an adhesion results of the upper layer with the lower layer in the region of this adhesive substance application. The two parts are thus adhered with one another and form between them a relatively flat adhesive substance bead, which extends into the upper layer as well as also into the layer and connects the two layers elastomerically with one another.

A preferred embodiment of the invention provides that the thickness of the adhesive substance bead is approximately 2 to 3 mm, with the width of the adhesive substance bead extending approximately in the range from 2 mm to 20 mm.

The wider the adhesive substance bead is implemented, the higher is the support force in the region of the undergarment in which a corresponding support force is desired.

Accordingly the width of the adhesive substance bead depends on the type of the undergarment and, incidentally, the widest adhesive substance bead is also applied depending on the site on the undergarment at which the greatest support force is to be attained.

A further implementation of the present invention provides that an adhesive substance bead is not only developed as an adhesive substance bead enwrapped be an upper and a lower layer of the undergarment, but rather that still additional adhesive substance application dots are applied onto the undergarment at the sites at which greater support force is desired.

Such application dots penetrate the upper as well as also the lower layer and are distributed dot-wise in mutual spacing from one another, and the dots, in the range from approximately 2 mm to 5 mm diameter, can be arranged with a mutual distance of for example 1 mm (minimum) and 20 mm (maximum).

The closer such adhesive substance application dots are disposed with respect to one another, the greater is the support and holding force of the undergarment at this point.

As the material for the adhesive substance an elastomeric silicone adhesive is employed, which can be developed as a single-component adhesive substance or also as a multi-component adhesive substance. However, the invention is not limited to this, other known elastomeric adhesive substances can also be employed, such as, for example unvulcanized rubber adhesive substances, polyurethane adhesive substances and the like more.

Due to the use of an elastomeric adhesive substance margin, which forms, for example in the case of a brassiere, the margin region, an additional damping effect is obtained, i.e. the adhesive substance bead due to its elastomeric behavior, dampens impacts onto this brassiere such that such a garment is also well suited for sports activities.

It is understood, that the invention is not limited to the development of an undergarment as a brassiere; it is also possible to produce support pants and pantie-girdles, cycling pants and the like sports items.

The subject matter of the present invention is not only evident based on the subject matter of the individual patent claims, but also based on the combination of the individual patent claims with one another. All specifications and characteristics disclosed in the document, including the abstract, in particular the graphic representation depicted in the drawings, are claimed as being essential to the invention to the extent they are individually or in combination novel relative to prior art.

In the following the invention will be explained in further detail in conjunction with drawings representing several embodiment paths. In the drawings and their descriptions, further characteristics and advantages, essential to the invention, of the invention are evident.

DETAILED DESCRIPTION OF THE PREFERRED EMBODIMENTS

Figure 1:
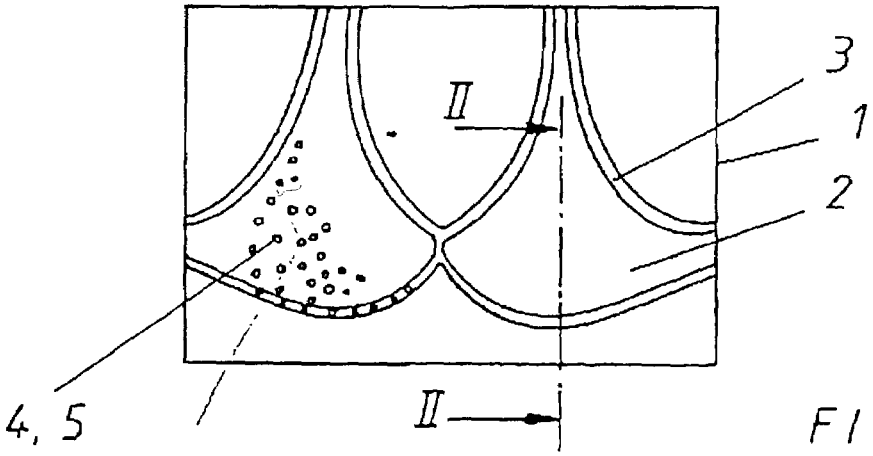
FIG. 1 schematically a top plan view onto the production of a brassiere in a silk screen method, FIG. 2 section along line II—II in FIG. 1, FIG. 3 representation according to FIG. 2 with the silk screen removed, FIG. 4 the representation according to FIG. 3 with the silk screen device removed, FIG. 5 two embodiment examples of other applications on a brassiere, FIG. 6 a further embodiment example of the application of the invention on the side portion of a brassiere, FIG. 7 section through the margin region of a garment in a further embodiment.

In FIG. 1 is shown the top plan view according to which in a silk screen frame 1 a brassiere 2 is placed, whose marginal region or outline 3 is equipped with an adhesive substance bead.

Further shown is the left brassiere portion 4 of this brassiere 2 which still additional adhesive substance application dots are applied. The density of the application dots depends on where the greatest degree of force is desired. The greater the support force is to be, the closer the application dots must be with respect to one another. Thus, in FIG. 1, in the left lower and in the outer region of the brassiere portion 4 the density of the application dots 5 is greater than in the central region of the brassiere portion 4.

Figure 2:
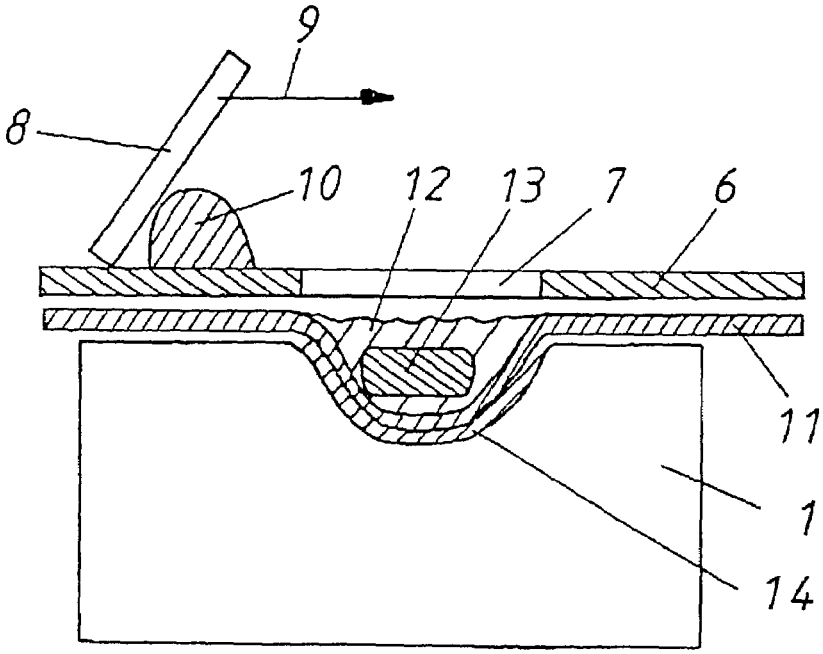

The application of an adhesive substance bead according to the right-hand representation in FIG. 1 takes place with a silk screen configuration according to FIG. 2. Herein a silk screen 6 is placed onto the lower layer 11 of the brassieres 2, with a recess 14 being formed in the silk screen frame 1 in the area which subsequently becomes the margin region. The lower layer 11 is pressed into this recess such that a receptacle is formed which is filled with the adhesive substance 12. The adhesive substance 10 is herein passed with a silk screen squeegee 8 through corresponding screen apertures 7, with the squeegee being moved in the direction of arrow 9.

Consequently, a complete adhesive substance application 12 takes place in the region of the recess 14. It is important that into this recess 14 still additionally insertion parts can be placed, such as for example a wire 13, which in this case is completely enveloped and encompassed by the adhesive substance application 12.

Figure 3:
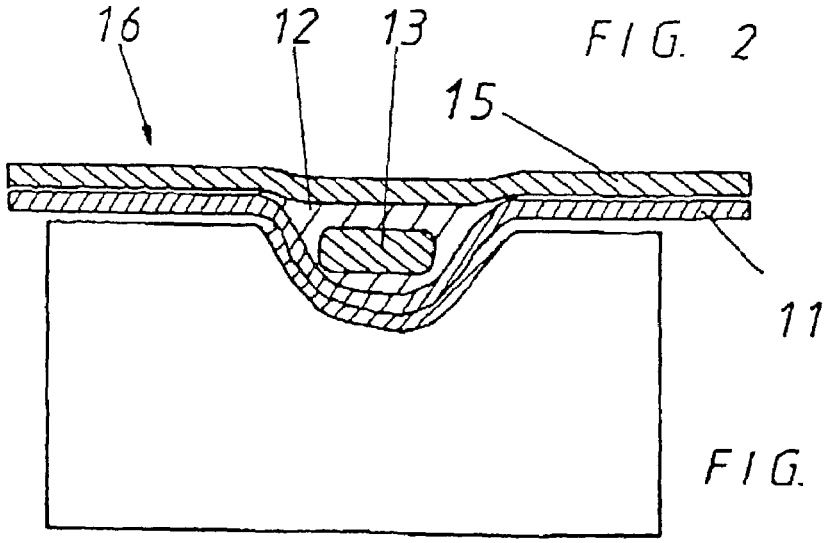

After the adhesive substance application 12 in the lower layer 11 has been completed, an upper layer 15 according to FIG. 3 is placed onto the lower layer 11 and, in the region of the recess 14, the two parts are pressed against one another such that the adhesive substance application 12 penetrates also into the upper layer 15 and joins the two layers with one another in this region.

It is now possible to cut the garment in the region of a cutting edge 16, whereby the previously described margin region 3 results.

Figure 4:
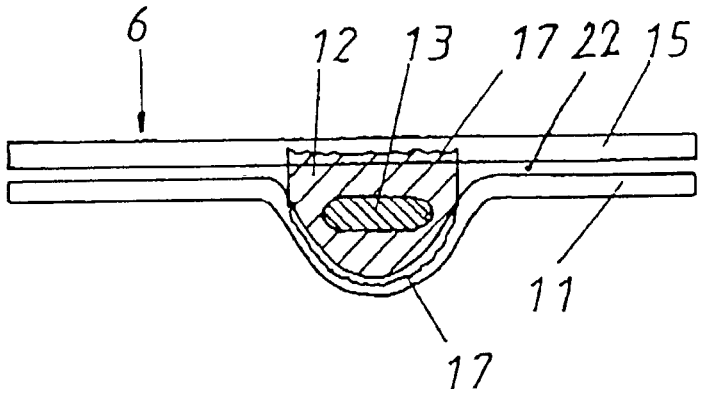

According to FIG. 4 it is evident that the adhesive substance application 12 has extended also into the extension regions 17 into the upper and lower layer 11, 15, such that the two layers are joined one to the other through the previously described adhesive substance bead (adhesive substance application 12).

FIG. 4 shows simultaneously that here the wire 13 is fully encompassed by the adhesive substance and is secured on all sides such that no interfering abutment edges result. Thus, the wire 13 is completely enveloped.

Consequently, very high wearing comfort results since in the proximity outside of the adhesive substance seam, the layers are disposed loosely one on the other, i.e. they can form an interspace 22 with one another, whereby the wearing comfort is further improved. Hereby breathing activity is significantly improved since a corresponding air cushion is formed in the interspace 22, which has a climatizing effect.

Figure 5:
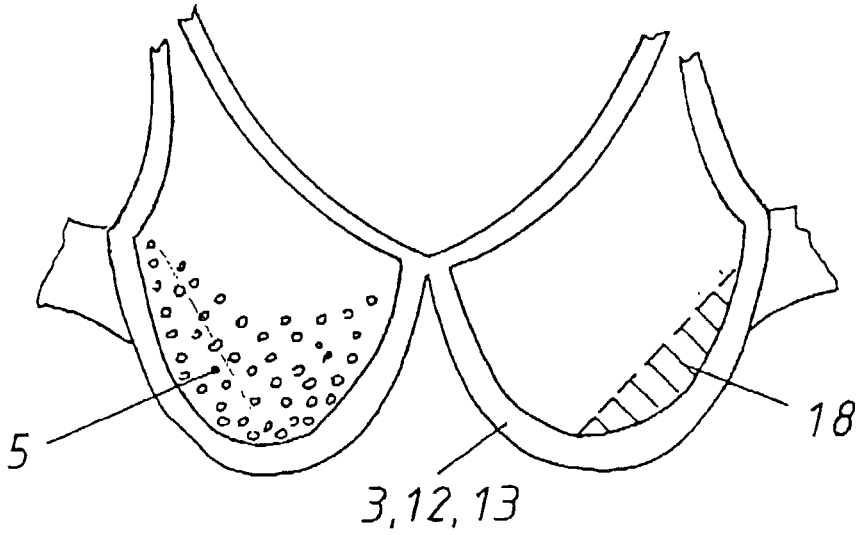

FIG. 5 shows as a further embodiment that an adhesive substance bead can be provided not only in the marginal region 3 according to FIG. 4, but also outside of the marginal region 3, so that an additional continuous coating region 18 is formed as well. This additional continuous coating region 18 is developed such that it is extremely flat between the upper and lower layers and just enough adhesive substance is employed so that the extension regions 17 do not penetrate through the surfaces of the upper and lower layers. Thus, in this coating region 18 only the upper and lower layers adhere to one another without the adhesive substance penetrating from the surface. Based on this, it is evident that here an excellent degree of support elasticity is achieved for, in addition to the elasticity of the marginal region 3, entire coating regions 18 are elastomerically equipped.

Figure 6:
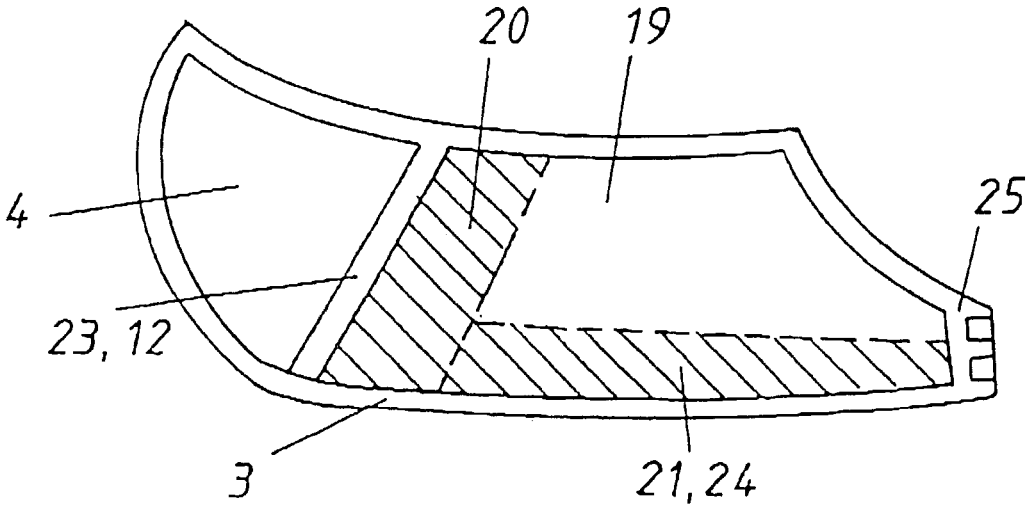

Such an application example is also shown in FIG. 6, in which it is evident that in a side portion 21 in a lower margin region 3 (which is equipped with the adhesive substance bead) a lower margin 24 is equipped with the coating corresponding to the above described coating region 18. Hereby an excellent support and shape force results, especially even if in the side portion 19 additionally a coating region 20 is provided, extending parallel to the bust portion 4 and extending somewhat obliquely upwardly, which is developed in the same way as the coating region 18.

The two coating regions 20, 21, can herein transition onto into the other in order to yield excellent support and shape elasticity in side portion 19.

The margin region 23 in this case is only equipped with an adhesive substance bead without in this region the wire 13 needing to be disposed.

FIG. 6 incidentally shows that in the adhesive substance bead also corresponding closure elements 25 can be embedded.

Figure 7:
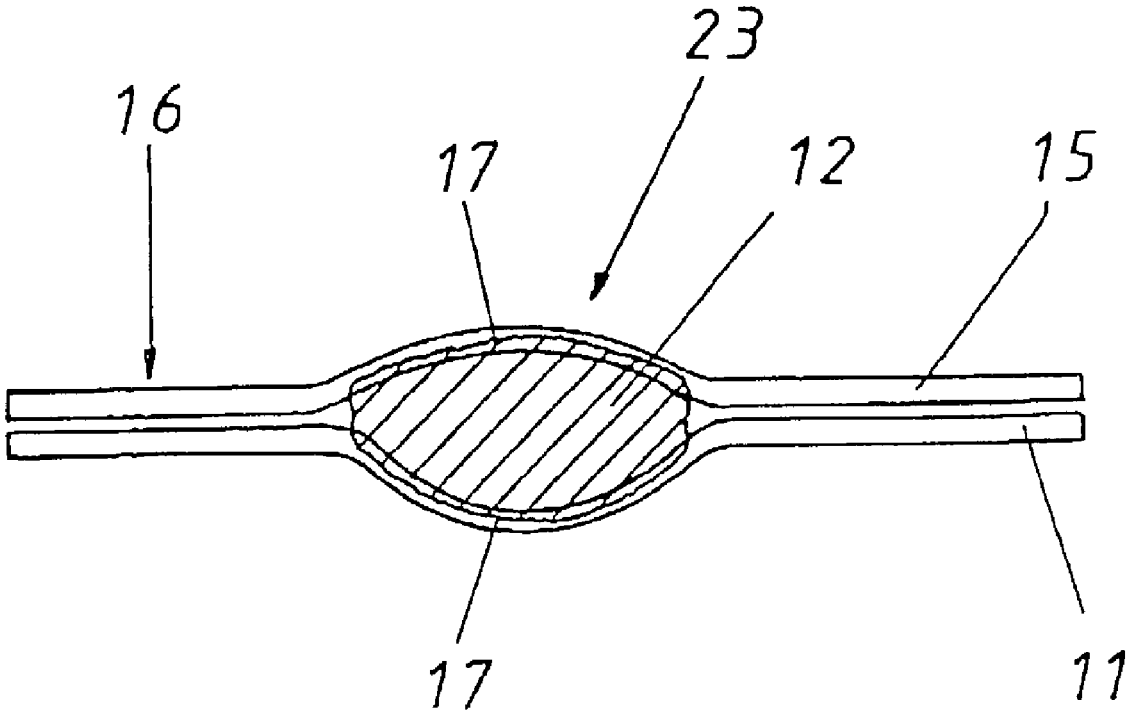

FIG. 7 depicts a section through such a margin region 23, wherein it can be seen that, by means of an adhesive substance application 12 (adhesive substance bead), the upper as well as also the lower layer are adhered one to the other, whereby a relatively flat (elliptic) adhesive substance bead results between the two layers and the adhesive substance extends only into the extension regions 17 of the two layers without reaching the surface.

FIG. 5 shows on the left-hand side that, in addition, to the improvement of the support elasticity, still adhesive substance dots in the form of application dots 5 can be applied.

Instead of a continuous bead, as is shown in FIG. 7, dot-form adhesive substance application dots can also be provided, as is shown in FIG. 5.

Such adhesive substance dots (application dots 5) have, incidentally, in addition a massaging effect provided they have the corresponding thickness. Such adhesive substance dots can therefore especially also be applied in the pants area—in the region of the seat in order to support the buttocks.

The invention claimed is:

1. A method for producing undergarments, comprising the steps of:

positioning at least a first layer of an undergarment on support frame;

said support frame including at least one recessed region defining an elastomeric adhesive receiving region, receiving at least a first region of said first layer into said at least one recessed region forming an complementary elastomeric adhesive receiving recess contacting said support frame;

selectively applying at least one elastomeric adhesive substance to said elastomeric adhesive receiving recess on said first layer, whereby said receiving recess is at least partially filled with said elastomeric adhesive substance;

positioning at least a second region of a second layer of said undergarment proximate said receiving recess; and applying a complementary pressure to said first and second regions of said first and second layers, and enabling a setting of said elastomeric adhesive forming a flat adhesive application, whereby said upper and lower layers adhere to each other where said elastomeric adhesive substance applications have been applied to form a high elasticity bond.

2. A method for producing undergarments, according to claim 1, wherein:

said high elasticity bond between said upper and lower layers has a thickness that is substantially equal to the sum of the thicknesses of the individual upper and lower layers.

3. A method for producing undergarments, according to claim 1, wherein:

during said step of applying a complementary pressure and enabling a setting of said elastomeric adhesive, a portion of said elastomer adhesive is integrated within a textile matrix of said first and second layers.

4. A method for producing undergarments, according to claim 1, wherein:

prior to the step of positioning at least a second region, conducting a step of:

positioning at least one substantially rigid member within said elastomeric adhesive receiving recess on said first layer;

said at least one substantially rigid member being encapsulated within said elastomeric adhesive substance, whereby following said steps of applying a complementary pressure and enabling a setting of said elastomeric adhesive, said at least one substantially rigid member is completely surrounded by said elastomeric adhesive and no interfering abutment edges are generated.

5. A method for producing undergarments, according to claim 4, where in:

said at least one substantially rigid member is selected from the group consisting of a wire, a hook closure, a zipper closure, and a fastener means.

6. A method for producing undergarments, according to claim 1, wherein:

said first and second regions of said respective first and second layers are ones selected from a group consisting of at least one margin region and at least one edge region; and said step of applying a complementary pressure and enabling a setting of said elastomeric adhesive forms a securely joined flexible bonding along said one of said margin region and said edge region of said undergarment.

7. A method for producing undergarments, according to claim 1, wherein:

said at least one recessed region being at least one of a semicircular region, an oval region, a deepened recess region, and a rectilinear region.

8. A method for producing undergarments, according to claim 1, wherein:

said elastomeric adhesive substance is one of a group consisting of:

an elastomeric silicone adhesive structured as a single-component adhesive substance; an elastomeric silicon adhesive structured as a multi-component adhesive substance, a polyurethane adhesive substance, and an unvulcanized rubber adhesive substance.

9. A method for producing undergarment, according to claim 1, wherein:

said step of selectively applying at least one elastomeric adhesive substance to said elastomeric adhesive receiving recess on said first layer incorporates a silk screen process.

* * * * *